United States Patent [19]

Manders

[11] Patent Number: 4,722,370

[45] Date of Patent: Feb. 2, 1988

[54] METHOD FOR CONVEYING A WEFT THREAD BY MEANS OF A FLOWING FLUID THROUGH THE WEAVING SHED IN A SHUTTLELESS WEAVING MACHINE, AS WELL AS WEAVING MACHINE ADAPTED FOR APPLYING SAID METHOD

[75] Inventor: Petrus G. J. Manders, Eindhoven, Netherlands

[73] Assignee: Ruti-Te Strake B.V., Deurne, Netherlands

[21] Appl. No.: 936,964

[22] Filed: Dec. 1, 1986

Related U.S. Application Data

[63] Continuation of Ser. No. 775,120, Sep. 12, 1985, which is a continuation of Ser. No. 534,275, Sep. 21, 1983, abandoned.

[30] Foreign Application Priority Data

Sep. 30, 1982 [NL] Netherlands ..... 8203808

[51] Int. Cl.[4] ..... D03D 47/00

[52] U.S. Cl. ..... 139/429; 139/435; 139/439

[58] Field of Search ..... 139/1 R, 116, 437, 429, 139/438, 439, 435

[56] References Cited

U.S. PATENT DOCUMENTS

| | | | |
|---|---|---|---|
| 4,446,893 | 5/1984 | Gunneman et al. | 139/435 |
| 4,450,876 | 5/1984 | Mullekom | 139/435 |
| 4,458,726 | 7/1984 | Wenig | 139/435 |

FOREIGN PATENT DOCUMENTS

| | | | |
|---|---|---|---|
| 2089381 | 6/1982 | United Kingdom | 139/439 |

*Primary Examiner*—Henry S. Jaudon

*Attorney, Agent, or Firm*—Burns, Doane, Swecker & Mathis

[57] ABSTRACT

The invention aims at equalizing weft time differences when launching successive threads and thereby obtaining a more uniform cloth. For that purpose the thread velocity in the initial phase of the weft is measured and on the basis thereof an additional pressure impulse of the conveying fluid may be supplied to the thread. According to a different possibility, in dependence on the measured value, the thread is more or less braked by means of a brake at the end of the weft phase.

13 Claims, 8 Drawing Figures

METHOD FOR CONVEYING A WEFT THREAD BY MEANS OF A FLOWING FLUID THROUGH THE WEAVING SHED IN A SHUTTLELESS WEAVING MACHINE, AS WELL AS WEAVING MACHINE ADAPTED FOR APPLYING SAID METHOD

This application is a continuation of application Ser. No. 775,120 filed Sept. 12, 1985, which in turn is a continuation of application Ser. No. 534,275 filed Sept. 21, 1983, now abandoned.

The invention relates to a method for conveying a weft thread through the weaving shed in a shuttleless weaving machine by means of a weft conveying system having a plurality of nozzles supplied with a flowing conveying fluid, in which the conveying velocity of each weft thread is measured, a signal which is representative for the measured conveying velocity is supplied to a control system in which said signal is converted into a control signal influencing the components of the weft conveying system which determine the velocity of the weft yarn.

Such a method is e.g. known from Dutch patent application 7908357. Therein the fact is already mentioned that weft yarns to be processed in pneumatic weaving machines present a certain natural divergence as to the weft conveying time necessary for the weft thread. As a compensation for the variations in weft conveying time occurring as a result thereof in this patent application a control system is proposed as an example, which amounts to this that one determines during a number of successive wefts the average weft time, compares it with a set design value and dependent on said comparison controls e.g. the pressure in the main blowing nozzle of the weft conveying system. In this manner "slow" variations, i.e. variations occurring along yarn lengths sweeping a multiple of the weft width are effectively compensated for.

The invention aims at providing a control system for compensation of weft time differences which are the result of variations occurring within the time schedule of a single conveying cycle as to "conveying capability" of the weft yarn.

According to the invention this aim is achieved in that one measures the velocity each time in the initial phase of the weft and switches on an auxiliary power source for the weft conveying system earlier or later, or switches off the main power source respectively earlier or later, the arrangement being such that the relative weft thread piece will complete the weft path in a predetermined point of time.

In a first practical embodiment additional to a main source a second source of a flowing fluid is used, the pressure thereof being higher than that of the main source and which may be operated through an electrically controlled valve.

However, as the auxiliary source also a brake, to be provided upstream of the inlet of the (first) nozzle of the weft conveying system, may be used, whereby the weft thread is more or less braked dependent on the measured velocity thereof.

The invention is hereunder further explained with reference to the drawings of some embodiments.

Figure 1:
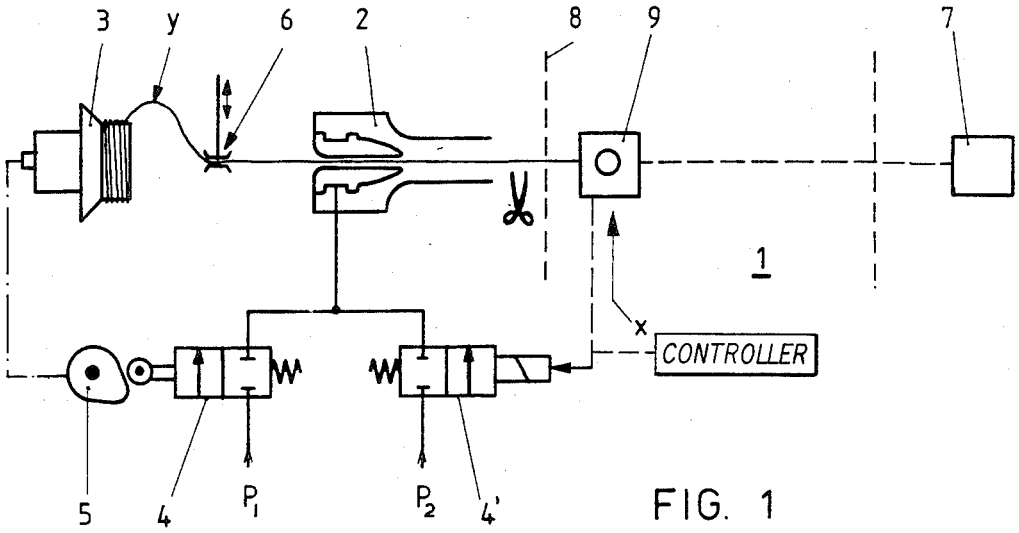
FIG. 1 shows a diagram of a weaving machine according to the invention in which a second source of the flowing conveying fluid is used as the auxiliary power source for the weft conveying system.

In FIG. 1 reference number 1 shows schematically the portion of the weaving machine containing the weaving shed. Reference number 2 indicates a nozzle provided at the one end of the weaving shed, to which nozzle on the one hand the weft yarn Y is supplied by the weft yarn preparation device 3 and which on the other hand is supplied via a valve 4 with a flowing fluid, e.g. compressurized air at a a pressure $p_1$. The valve 4 is periodically opened in known manner, e.g. mechanically by means of a rotating cam 5, namely each time at the start of the weft phase of a weaving cycle.

Reference number 6 indicates a yarn clamp operated by a conventional actuator and positioned upstream of the entrance of the nozzle 2, while a weft detector provided at the end of the weft path of a weft thread through the weaving shed is indicated by the reference number 7.

As described so far the weaving machine is of known construction. According to the invention the nozzle 2 is connected with a second valve 4' by which valve the nozzle may be supplied with pressurized air having a pressure $p_2$ which is higher than $p_1$. At the start of a weft insertion (i.e. when opening the yarn clamp 6 shortly before the valve 4 has been opened) the valve 4' is in the closed position. The question whether and at which point of time the valve 4' will be opened depends on the velocity which has been reached by the weft thread shortly after launching it through the nozzle 2. Thereto at the position indicated x in the weaving shed, a short distance of the left edge 8 of the cloth, a detector 9 has been provided, by means of which the point of time may be determined in which the head of the launched weft thread passes the point x. It will be clear that if the detector 9 signals the head of the launched weft thread at an earlier or later point of time after the yarn claim 6 has been opened, the weft thread has a higher or a lower velocity respectively. The signal generated by the detector 9 when signalling the head of the weft thread is now used as a control signal for opening the electromagnetically operated valve 4'. This valve is controlled such that it opens with a larger delay insofar as the head end of the weft thread is signalled at an earlier point of time. Therefore, if on the basis of the signalling point of time it may be concluded that one deals with a relatively "quick" weft thread a, for further conveying said weft thread through the weaving shed only a short additional pressure impulse $p_2$ will be supplied to the nozzle 2 in addition to the constant pressure impulse $p_1$, this additional pressure impulse being supplied during a longer time period in so far one is dealing with a less quick weft thread.

Figure 2:
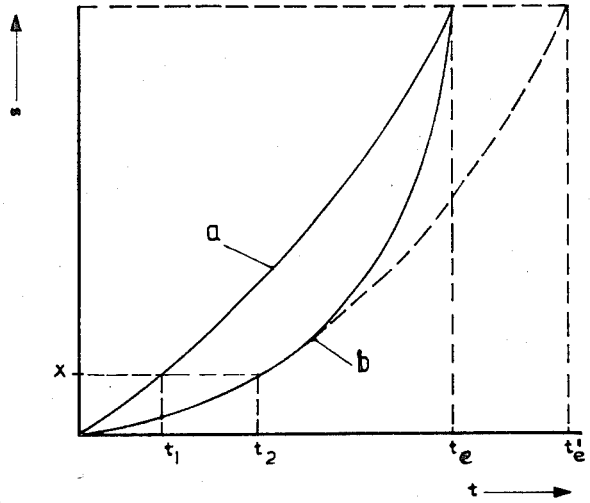
FIG. 2 shows a distance-time diagram for a "quick" and a "slow" weft thread when using the weaving machine according to FIG. 1.

In the diagram according to FIG. 2 the curves a and b relate to a quick and a slow weft thread respectively. The passage of the head end of the weft thread at the point x at the start of the weaving shed has been detected for the "quick" weft thread a at a relatively early point of time $t_1$, while the passage of the head end of the less quick thread b has been detected at an later point of time $t_2$. Through the application of the compensating control as described above in connection with FIG. 1 the head ends of both weft threads, however, have reached the opposite end of the weaving shed in the same desired point of time $t_a$. For comparison broken lines indicate how the distance-time diagram of the "slow" weft thread would have been without the described compensating control. The intially slow weft thread would have completed its weft conveying path then only in the point of time $t'_e$.

Figure 8:
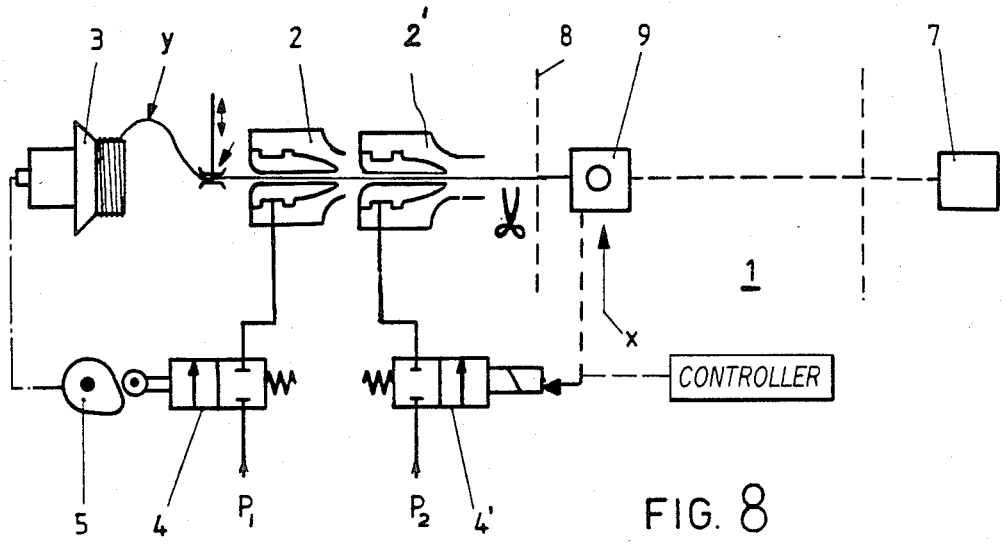
FIG. 8 is a diagrammatic view of a further embodiment of the present invention.

The additional pressure impulses through the electromagnetic valve 4' could also be supplied to a separate auxiliary nozzle 2' (FIG. 8) which then would be positioned downstream in series with the shown nozzle 2.

Figure 3:
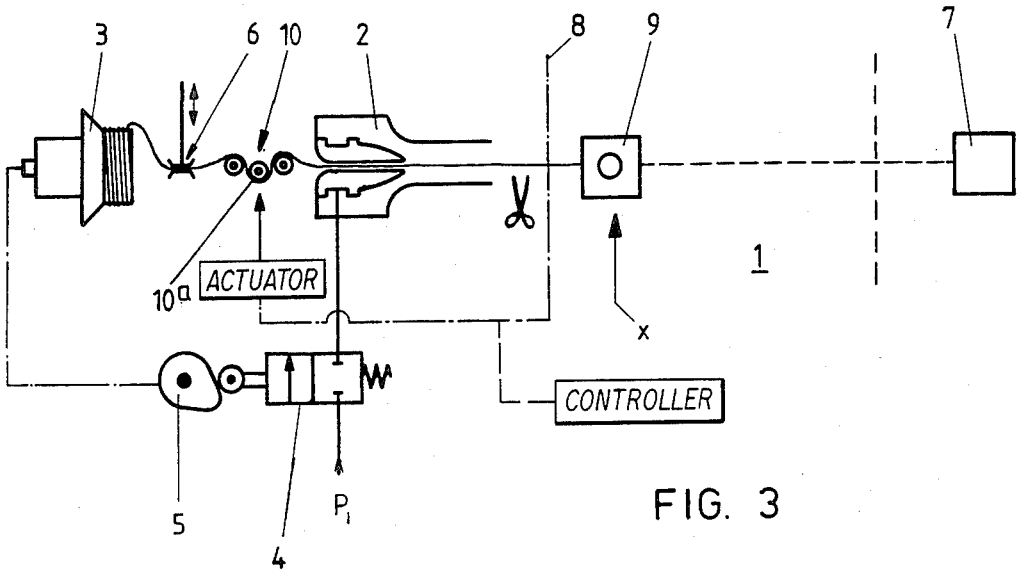
FIG. 3 shows a diagram of a weaving machine according to the invention in which an e.g. electromagnetically controlled brake, positioned upstream of the entrance of the blowing nozzle, is provided as the auxiliary power source for the weft conveying system.

Those components of the weaving machine shown in FIG. 3, corresponding to corresponding parts of the weaving machine according to FIG. 1, have been indicated by identical reference numbers.

Contrary to the weaving machine according to FIG. 1, in the weaving machine according to FIG. 3 a yarn brake 10, controlled by the detector 9 and positioned between the nozzle 2 and the yarn clamp 6, is used. The use of the brake 10 is based on the idea that it may be advantageous to brake the weft thread during the last portion of the weft phase, whereby the tension peak occurring when the thread is drawn taut at the end of the weft phase, may be lowered and thereby the chances of rupturing are reduced. According to the invention the desired compensating control may also be obtained through the yarn brake 10, namely by controlling the braking time and/or the brake force dependent on the velocity of the weft thread detected by the detector 9 in the initial phase. In the example of FIG. 3 the active element 10*a* of the yarn brake 10 will be moved, e.g. by solenoid actuation to its operative position at a later point of time (according to the direction of the arrow) in so far as the detector 9 has detected a lower velocity in the initial phase of the relative weft thread. Conversely a quicker weft thread will be braked at an earlier point of time.

Figure 4:
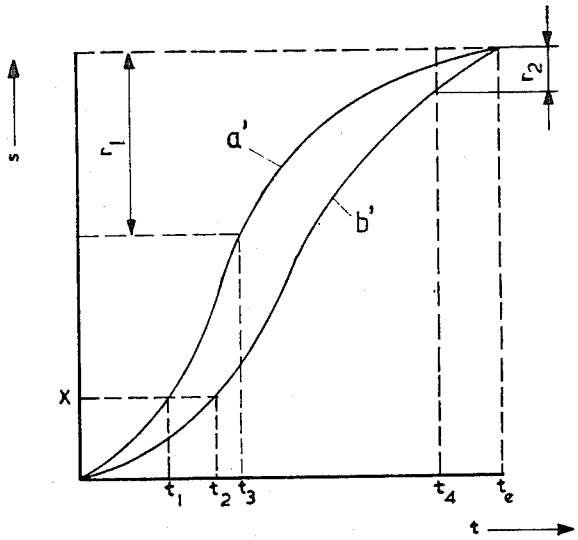
FIG. 4 shows a distance-time diagram of a "quick" and a "slow" weft thread when using the machine according to FIG. 3.

In the diagram according to FIG. 4 references a' and b' indicate a "quicker" and a less quick weft thread respectively which through the compensating control of the weaving machine according to FIG. 3 have completed the weft conveying path in the same time. The passage of the head end of the "quick" weft thread a' in point x of the weaving shed has been observed at the early point of time $t_1$. For compensation braking the thread has already started in the likewise relatively early point of time $t_3$. However, the passage in point x of the relatively slow weft thread b' has only been observed in the relatively late point of time $t_2$, so that for compensation thereof the braking of said thread has been postponed until the likewise relatively late point of time $t_4$.

Instead of providing the detector 9 in the position indicated x within the weaving shed, this could also be applied adjacent to the yarn preparation device 3 which in both examples of embodiment shown is of the drum type. Particularly the detector 9 could then be provided in the position indicated y (FIG. 1) in the pulling off path of the weft yarn and thereby observe in which points of time the successive windings of the prepared weft thread piece pass the point y.

Figure 5:
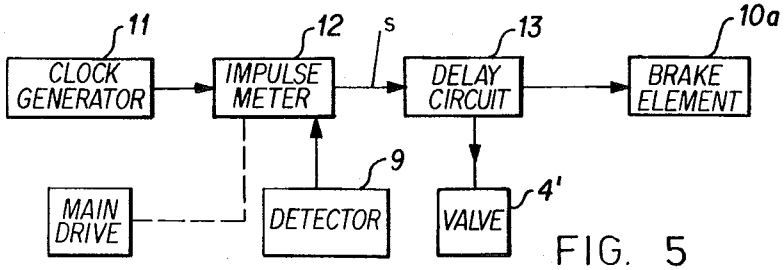
FIG. 5 shows an electric block diagram of the control system used with the weaving machine according to FIGS. 1 and 3.

The controller (FIGS. 1, 3, 6 and 8) of the auxiliary valve 4' or the variable yarn brake 10 respectively is shown in the block diagram according to FIG. 5. In this block diagram a clock generator 11 supplies an impulse meter 12 which is connected such with the main drive of the machine (from which main drive those of the cam 5 and the yarn preparation device 3 are derived) that the meter 12 is reset to zero after each insertion of the weft has been completed. After resetting, the meter 12 is restarted at the moment a new weft is released for insertion, i.e., at the moment at which the yarn clamp 6 is opened. Such restarting may be accomplished by the same signal (e.g., electrically) which also controls the actuator for opening the yarn clamp 6. The meter 12 furthermore, is connected with the detector 9 such that the meter is stopped as soon as the detector 9 observes the passing of the head end of the relative weft thread. The time pulses accumulated in this manner by the meter issue an output signal s which is a measure for the velocity of the weft thread in the initial phase of the weft. The signal s is supplied to a delay circuit 13 which supplies a generating signal with a delay factor dependent on the value of the signal s to the valve 4' in FIG. 1 or to the active yarn brake element 10*a* in FIG. 3 respectively.

Figure 6:
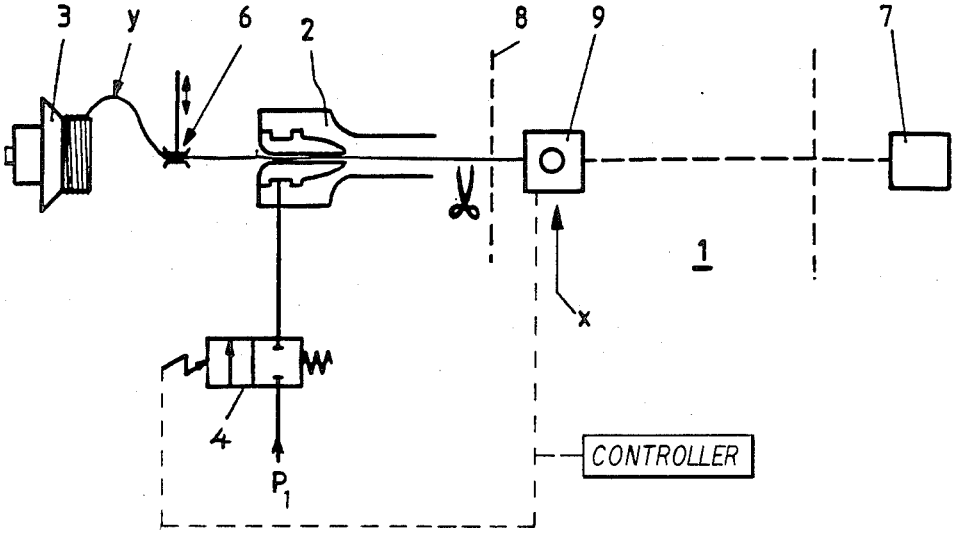
FIG. 6 shows an alternative embodiment in which a single power source for the conveying air system is used, said source being adapted to be switched off by means of an electrically controlled valve at an earlier or a later point of time.
Figure 7:
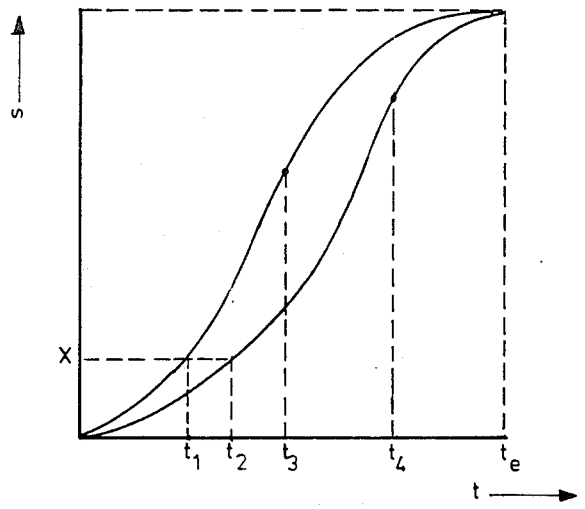
FIG. 7 shows the distance-time diagram of a "quick" and a "slow" weft thread relative to the modification according to FIG. 6.

The embodiment according to FIG. 6 may be considered as a modification of the embodiment according to FIG. 3 in which the brake 10 has been eliminated and the cam control 5 of the valve 4 has been replaced by an electric control circuit which causes the earlier or later closing of the valve 4 dependent on the signal received from the detector 9.

What is claimed is:

1. A method for conveying a weft thread through a weaving shed in a shuttleless weaving machine through the intermediary of a weft conveying system having at least one nozzle which is supplied with a flowing conveying fluid, the conveying velocity of each weft thread being measured, supplying a signal which is representative for the measured conveying velocity to a control system in which the signal is converted into a control signal which influences the components of the weft conveying system, said weft conveying system determining the velocity of the weft thread, the velocity being measured each time in the initial phase of the weft insertion, controlling the time of actuation of an auxiliary power source for the weft conveying system depending on the measured value, such that the relative weft thread piece completes the weft path in a predetermined length of time, the auxiliary source comprising a second source of a flowing fluid, the pressure of the second source being higher than that of the main source and being operated through an electrically controlled valve.

2. A pneumatic weaving machine for conveying a weft thread through a weaving shed in the weaving machine through the intermediary of a weft conveying system, comprising at least one nozzle which is supplied with a flowing conveying fluid, means for measuring the conveying velocity of each weft thread, means for supplying a signal which is representative for the measured conveying velocity to a control system in which the signal is converted into a control signal which influences the components of the weft conveying system, said weft conveying system determining the velocity of the weft thread, the velocity being measured each time in the initial phase of the weft insertion, means for controlling the time of actuation of an auxiliary power source for the weft conveying system dependent on the measured value, such that the relative weft thread piece completes the weft path in a predetermined length of time.

3. A method for conveying a weft thread through a weaving shed in a shuttleless weaving machine through the intermediary of a weft conveying system having at least one nozzle which is supplied with a flowing conveying fluid, the conveying velocity of each weft thread being measured, supplying a signal which is representative of the measured conveying velocity to a control system in which the signal is converted into a control signal which influences the components of the weft conveying system, said weft conveying system determining the velocity of the weft thread, the velocity being measured each time in the initial phase of the weft insertion, controlling the time of actuation of a main power source for the weft conveying system such that the relative weft thread piece will complete the weft path in a predetermined length of time.

4. A pneumatic weaving machine for conveying a weft thread through a weaving shed in a shuttleless weaving machine through the intermediary of a weft conveying system, comprising at least one nozzle which is supplied with a flowing conveying fluid, means for measuring the conveying velocity of each weft thread, means for supplying a signal which is representative of the measured conveying velocity to a control system in which the signal is converted into a control signal which influences the components of the weft conveying system, said weft conveying system determining the velocity of the weft thread, the velocity being measured each time in the initial phase of the weft insertion, means for controlling the time of actuation of a main power source for the weft conveying system such that the relative weft thread piece completes the weft path in a predetermined length of time.

5. A method of weaving with an air jet loom in which the time intervals consumed in each of successive weft insertion operations is regulated to minimize deviations from a predetermined time interval, said method comprising sensing movement of the weft during an initial phase of a weft insertion operation to provide a measure of the velocity of the weft in said initial phase of that weft insertion operation, providing a signal indicative of the measured value, applying additional velocity-affecting forces to the weft during only a portion of that part of the weft insertion operation which remains after said initial phase, and controlling in response to said signal during said portion of the weft insertion operation the length of time during which said additional velocity-affecting forces are applied to said weft to compensate for a deviation of said measured value from a predetermined value.

6. The method according to claim 5, wherein said velocity-affecting forces are drag forces exerted by dragging means for slowing down the weft near the end of each weft insertion operation, and wherein said controlling step is carried out by actuating said dragging means earlier or later in the weft insertion operation.

7. The method according to claim 5, wherein said velocity-affecting forces include at least one weft conveying nozzle, and wherein said controlling step is carried out by supplying additional fluid or fluid pressure to the at least one nozzle earlier or later in the weft insertion operation.

8. An apparatus for weaving with an air jet loom in which the time intervals consumed in successive weft insertion operations are regulated to minimize deviations from a predetermined time interval, said apparatus comprising means for sensing movement of the weft during an initial phase of a weft insertion operation to provide a measure of the velocity of the weft in said initial phase of that weft insertion operation, means for providing a signal indicative of the measured value, means for applying additional velocity-affecting forces to the weft during only a portion of that part of the weft insertion operation which remains after said initial phase, and means for controlling during said portion of the weft insertion operation in response to said signal the length of time during which said additional velocity-affecting forces are applied to said weft to compensate for a deviation of said measured value from a predetermined value.

9. Apparatus according to claim 8, wherein the means for sensing movement of the weft is arranged adjacent a weft yarn preparation device.

10. The apparatus according to claim 8, wherein said means for applying velocity-affecting forces includes dragging means for slowing down the weft near the end of each weft insertion operation and wherein said means for controlling actuates said dragging means earlier or later in the weft insertion operation.

11. The apparatus according to claim 8, wherein said means for applying velocity-affecting forces include at least one conveying nozzle, and wherein said means for controlling supplies fluid to the at least one nozzle earlier or later in the weft insertion operation.

12. A method of weaving with an air jet loom in which the time intervals consumed in successive weft insertion operations are regulated to minimize deviations from a predetermined time interval, said method comprising sensing the weft insertion to provide a measure of the velocity of the weft, providing a signal indicative of the measured value, applying drag forces with drag means to the weft during a terminal end portion of the weft insertion operation, controlling in response to said signal during that terminal end portion of the weft insertion operation the length of time during which said drag forces are applied to said weft to compensate for a deviation of said measured value from a predetermined value, and stopping said weft insertion operation with a terminating means after a predetermined length of weft thread has been inserted.

13. An apparatus for weaving with an air jet loom in which the time intervals consumed in successive weft insertion operations are regulated to minimize deviations from a predetermined time interval, said apparatus comprising means for sensing the weft insertion to provide a measure of the velocity of the weft, means for providing a signal indicative of the measured value, means for applying drag forces to the weft during a terminal end portion of the weft insertion operation, means for controlling during said terminal end portion of the weft insertion operation in response to said signal the length of time during which said drag forces are applied to said weft to compensate for a deviation of said measured value from a predetermined value, and means for stopping said weft insertion operation after a predetermined length of weft thread has been inserted.

* * * * *